US006210267B1

(12) United States Patent
Long et al.

(10) Patent No.: US 6,210,267 B1
(45) Date of Patent: Apr. 3, 2001

(54) APPARATUS AND METHOD FOR USE OF AN AIR RAIL

(75) Inventors: Shane Long, Uncaville, CT (US); David Warren, Tillson, NY (US)

(73) Assignee: Gaming Edge Products, L.L.C., Tillson, NY (US)

( * ) Notice: Subject to any disclaimer, the term of this patent is extended or adjusted under 35 U.S.C. 154(b) by 0 days.

(21) Appl. No.: 09/257,912

(22) Filed: Feb. 26, 1999

Related U.S. Application Data

(60) Provisional application No. 60/076,265, filed on Feb. 27, 1998, and provisional application No. 60/081,385, filed on Apr. 10, 1998.

(51) Int. Cl.[7] ..... F24F 9/00

(52) U.S. Cl. ..... 454/189; 454/190; 454/191

(58) Field of Search ..... 454/188, 189, 454/190, 191, 192, 193

(56) References Cited

U.S. PATENT DOCUMENTS

| | | | | |
|---|---|---|---|---|
| 2,500,606 | * | 3/1950 | Dosmar | 98/36 |
| 2,507,634 | | 10/1950 | Hill . | |
| 2,572,120 | * | 10/1951 | Dixon | 230/241 |
| 3,350,994 | | 11/1967 | Guibert . | |
| 3,715,122 | * | 2/1973 | Brown | 273/136 Z |
| 3,803,995 | | 4/1974 | Allander . | |
| 4,248,162 | | 2/1981 | Skeist . | |
| 4,606,259 | | 8/1986 | Nyström . | |
| 4,623,367 | | 11/1986 | Paulson . | |
| 4,989,504 | * | 2/1991 | Catan | 98/36 |
| 5,133,788 | | 7/1992 | Backus . | |
| 5,264,015 | | 11/1993 | Matsui . | |
| 5,417,433 | * | 5/1995 | Phillips | 273/309 |
| 5,441,279 | * | 8/1995 | Messina | 273/309 |
| 5,562,286 | * | 10/1996 | Brinket | 273/309 |

FOREIGN PATENT DOCUMENTS

| | | |
|---|---|---|
| 787952 | 9/1996 | (EP) . |
| 2698955 | 6/1996 | (FR) . |
| 4-62347 | 2/1992 | (JP) . |
| 5-223304 | 8/1993 | (JP) . |

OTHER PUBLICATIONS

Abstract of Published Japanese Patent Application No. JP 01–266770.

* cited by examiner

*Primary Examiner*—Pamela Wilson
(74) *Attorney, Agent, or Firm*—Dorsey & Whitney LLP

(57) ABSTRACT

An apparatus and method for minimizing the amount of smoke to which a shielded person is exposed. The apparatus, or air rail, has a conduit and a fan. The conduit has an air outlet through which air is forced by the fan. In operation, the fan generates an air flow that enters the conduit and exits through the air outlet. The exited air flow is directed generally away from the shielded person and is interposed between the shielded person and the smoke. The exited air flow therefore creates a barrier which minimizes the amount of smoke to which the shielded person is exposed. By minimizing the amount of smoke to which the shielded person is exposed, the apparatus and method creates a better environment for the shielded person.

48 Claims, 15 Drawing Sheets

APPARATUS AND METHOD FOR USE OF AN AIR RAIL

RELATED APPLICATIONS

This application is related to U.S. Provisional Application, Serial No. 60/076,265, filed Feb. 27, 1998 and U.S. Provisional Application Serial No. 60/081,385 filed Apr. 10, 1998, both for an AIR RAIL, invented by Shane Long and David Warren, and both of which are incorporated herein by reference.

BACKGROUND

In the gaming industry, second hand smoke is an ongoing problem for dealers, pit bosses, employees, and customers alike. Second hand smoke creates unpleasant working conditions and is a health hazard. It has been known for over a decade that second hand smoke is nearly as likely to cause lung cancer as direct smoke itself. Casinos, however, want their customers to enjoy themselves. More specifically, casinos encourage their patrons to enjoy things like gambling, drinking, and smoking. Indeed, outside of some smokey pubs, bars, taverns, and saloon's, casinos are the last refuge for the smoker.

Unfortunately for the casino dealer, the heavy smoking of the clientele does not make life easier, more enjoyable, or healthier. When dealing at a casino gaming table, such as a blackjack table, the dealer is often confronted with a table full of smokers. The smokers often do not care what direction their exhaled smoke goes in, or worse, they directly aim it towards the dealer. Furthermore, the circulation in casinos often causes the smoke to be blown towards the dealer no matter where the smokers aim it.

Outside of the casino environment, there are many similar situations of unwanted smoke, air, odors, or vapors. In the aforementioned bars, taverns, pubs, and saloons there are many bartenders who do not want to be exposed to second hand smoke. In shops and labs, many people deal with chemicals and other material that produce unwanted vapors. Likewise, there are many similar situations with unwanted odors.

What is needed is an apparatus that inhibits and/or hampers the amount of smoke, vapors, and odors a person is exposed to.

What is needed is an apparatus that checks, constrains, or reduces the amount of smoke, vapors, and odors a person is exposed to.

What is needed is an apparatus that limits, restricts, and/or minimizes the amount of smoke, vapors, and odors a person is exposed to.

What is needed is an apparatus that protects and/or shields a person from smoke, vapors, and odors.

SUMMARY OF THE INVENTION

The invention is generally an apparatus that reduces, minimizes, or eliminates the amount of smoke vapor or odor that a person at a table is exposed to. More specifically, the invention creates a barrier of air interposed between the protected person and the air borne nuisance. Preferably, the barrier of air is created using an air rail.

Generally, the air rail comprises a fan, a conduit, and an air outlet. The fan moves air or creates an air flow, a substantial portion of which moves through the air conduit and exits out the air outlet. The exited air is interposed between the person and the smoke. The interposed air creates a barrier of air in front of the person at the table which reduces or prevents the smoke reaching the person. The air rail is generally mounted on the side or edge of the table closest to the person being shielded or protected from the smoke or other airborne nuisance.

It is an object of this invention to create an apparatus that inhibits and/or hampers the amount of smoke, vapors, and odors a person is exposed to.

It is an object of this invention to create an apparatus that checks, constrains, or reduces the amount of smoke, vapors, and odors a person is exposed to.

It is an object of this invention to create an apparatus that limits, restricts, and/or minimizes the amount of smoke, vapors, and odors a person is exposed to.

It is an object of this invention to create an apparatus that protects and/or shields a person from smoke, vapors, and odors.

DETAILED DESCRIPTION

The invention relates to an apparatus that eliminates, hampers, inhibits, checks, constrains, refrains, restricts, limits, reduces, or minimizes exposure to second-hand smoke or other air-bourne contaminants. More particularly, it relates to an air rail for use on a table that is not only simple to use, but is also reliable, durable, and easy to manufacture. The air rail shields a person at a table by creating a positive air flow up and away from the shielded person. If, for example, there are other people smoking at the table, the shielded person is shielded from the smoke. This positive air flow is generally at a 90 degree or smaller angle away from the top of the table or surface that the air rail is mounted on. For ease of description the air rail examples are described as being used to block smoke, however, the embodiments may be used for any airborne nuisances or contaminants. Likewise, the shielded person may be a dealer, agent, vendor, bartender, pit boss, pit runner, pit manager, waiter, waitress, machinist, cook, or any one else exposed to smoke, contaminants, or other airborne nuisances.

Figure 1:
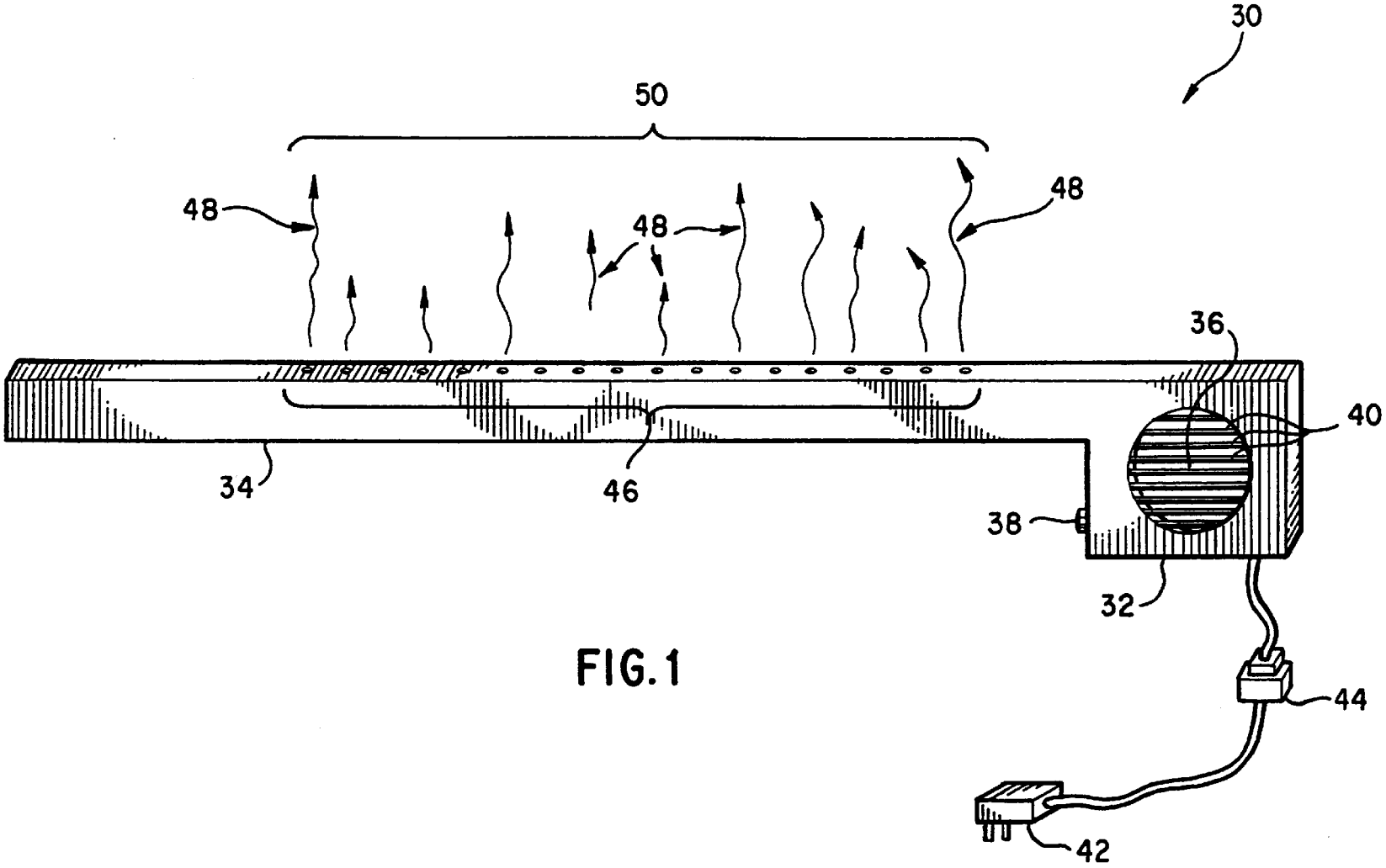
FIG. 1 shows a side view of an embodiment of the air rail.

A preferred embodiment of the air rail 30 is shown in FIG. 1. The air rail 30 comprises a fan 32 and a conduit 34. The fan 32 intakes air, moves air and/or creates an air flow. Generally, the CFM of the fan 32 ranges from 8 CFM to 60

CFM. Preferably, the fan 32 has a CFM of 24. The fan 32 ordinarily comprises an air intake 36, a fan outlet (not shown), blades (not shown), a motor (not shown), and an on/off switch 38. The air intake 36 is an opening that allows the fan 32 to intake air. As shown in FIG. 1, the fan 32 may have fan vents 40 that regulate the amount of air that is taken in and that prevent fingers and clothing from touching the fan blades. The air intake 36 is generally aligned in the same manner as the fan 32 itself. In FIG. 1, the fan 32 and the air intake 36 are aligned vertically, but, the air intake 36 may also be positioned horizontally or at any other angle.

The fan outlet is an opening that allows the moved air or air flow to exit the fan and enter the conduit 34. The fan 32 and the conduit 34 are generally connected at the fan outlet of the fan 32. The fan outlet can connect to the conduit in a variety of ways. For example, the fan outlet can have a male end (not shown) which slides inside a female end (not shown) on the conduit 34, or vice-versa. Alternatively, the fan outlet can be molded or glued to the conduit 34 during the manufacturing of the conduit 34. Other means of connecting the fan 32 to the conduit are discussed below.

The blades are located within the fan 32, and when the blades turn, they intake the air through the intake 36 and move the air and/or create the air flow. The blades are generally aligned perpendicular to the direction of the air flow through the conduit, although the blades may be aligned parallel to this air flow.

The motor is located within the fan 32, and when on, the motor turns the blades, to cause the blades to move the air and/or create the air flow. The motor may turn the blades directly or indirectly, through a belt or similar means. The motor generally has one speed, although it may have multiple speeds, thus providing for adjustability. The motor is preferably a DC motor, in which case the fan 32 also has a AC/DC converter 42. A DC motor is safer in an environment where drinks are often spilled. The fan 32 may also have a quick-disconnect 44 which may be used to cut off power to the fan 32 to prevent electrocution or any other mishap. Likewise, the fan 32 may have a fuse, a circuit breaker, an automatic or safety shut-off, and/or manual shut-off for protecting the fan and the person from short-circuits, voltage spikes, electrocution or any other problem associated with an electrical device. The on/off switch 38 may be located at any conveniently accessible position on the fan 32. The fan 32 may also have a filter (not shown) which filters the air and keeps the fan clean. It is noted that a commercially available, off-the-shelf fan may be used.

The conduit 34 is preferably connected to the fan 32, as shown in FIG. 1, so that a substantial portion of the air moved or air flow created by the fan 32 enters and travels through the conduit 34. The conduit 34 is placed on the end or side of the table (not shown) where the person (not shown) being shielded is standing or sitting. The conduit 34 may be connected to the top, edge, or side of the table at the end or side where the air rail is placed. The preferred length of the conduit 34 depends on the length of the end or side of the table where it is placed. The conduit should be approximately as long as the table end or side. For a typical casino gaming table, the conduit length would be approximately four feet. The height of the conduit 34 can range between approximately 1 inch and 6 inches, but, is preferably approximately 3 inches. As illustrated by these dimensions and the Figures, the conduit 34 is generally rectangular in shape, although the top surface with may be rounded. In alternative embodiments, the conduit 34 may be cylindrical, triangular, pyramidal, or a variety of other shapes. Furthermore, the width of the conduit may range between ¼ inch to 3 inches, but, is preferably approximately 1 inch. The conduit may be made of a variety of materials, including, plastics, plexiglass, wood, poly-carbon, aluminum (similar to aluminum air ducts), composite material, metal, natural, or man-made materials.

Referring to FIG. 1, the conduit 34 has an air outlet 46 that allows the air to exit the conduit 34. Generally, the air outlet 46 is located on the top surface of the conduit 34 and comprises a plurality of holes or vents, as shown in FIG. 1. The size of the air outlet 46 is variable, but, it can range from holes or vents with a diameter of approximately one sixteenth (1/16) of an inch to two inches to a hole or vent as long as conduit and a sixteenth (1/16) of an inch wide to 2 inches wide. The holes or vents are preferably circular, although they may be rectangular, square, or a variety of different shapes. Generally, spacing of the holes or vents varies from a quarter (¼) inch to a foot or greater. In the preferred embodiment, the holes or vents are circular with a one-quarter inch (¼") diameter, spaced two inches apart, and are positioned at a 60° angle above the plane of the table and 30° from a line through the center of the top of the conduit. One method of creating the holes or vents is to drill through the top of the conduit with a one-quarter inch (¼") drill bit at the desired angle.

A substantial portion of the air that travels through the conduit 34 exits through the air outlet 46. This exited air 48 is interposed between the shielded person and the smoke (not shown) to create a barrier 50 between the shielded person and the smoke and/or restrict the amount of smoke that reaches the shielded person. The number of the holes or vents, the location of the holes or vents, and the size of the holes or vents affect the size and shape of this barrier 50. The exited air 48 is interposed in a generally vertical direction or at an angle slanting away from the shielded person. Preferably, the interposed air rolls away from the shielded person and towards the smoke at the top or peak of its trajectory.

Figure 2A:
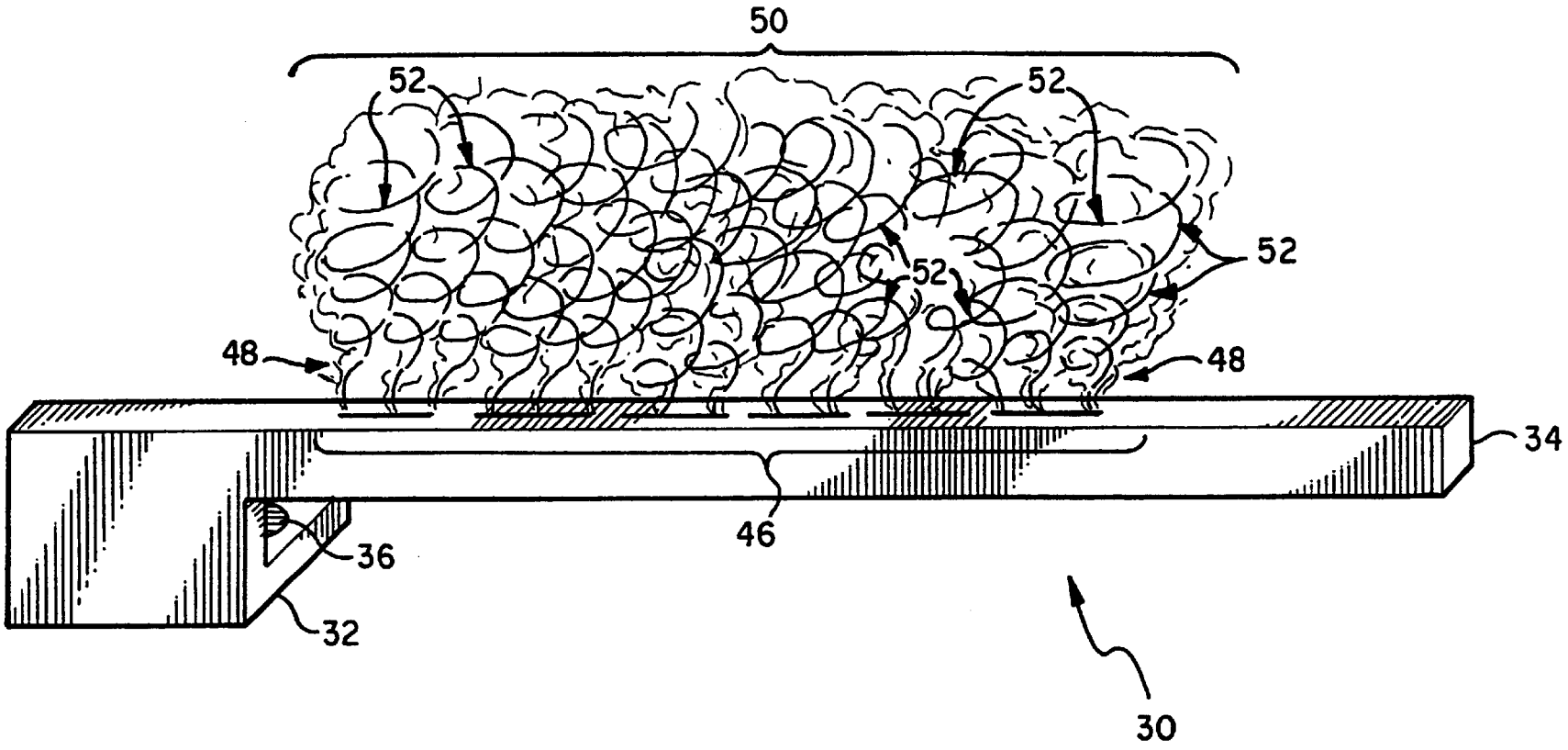
FIGS. 2*a* and 2*b* show perspective views of an embodiment of the invention with eddies.
Figure 2B:
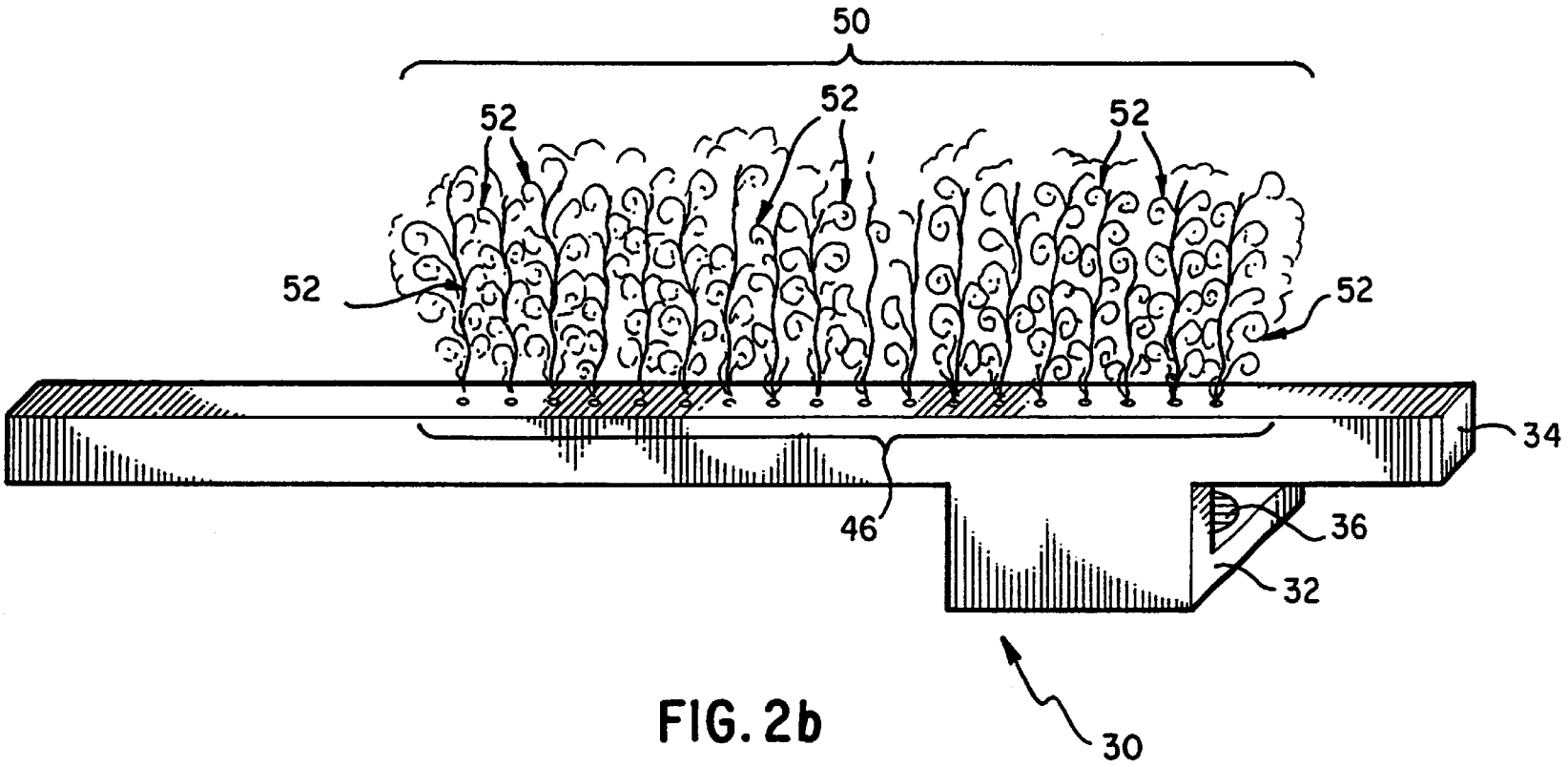

The air rail 30 may create the barrier 50 or minimize the amount of smoke that the shielded person is exposed to by creating various eddies 52 in the air flow, as shown in FIGS. 2*a* and 2*b*. The eddies 52 are created when the exiting air 48 rolls over in a circular motion and is blown back upwards again or when the exiting air 48 causes neighboring air to roll, as seen in FIGS. 2*a* and 2*b*. The eddies 52 may be created by varying the air flow, the shape of the air outlet 46, the relative positioning of the air outlet 46, or in any other manner normally used to create eddies 52. For example, if two adjacent outlets are positioned so that the air flows exiting from each crosses, eddies 52 may be created. The eddies 52 should roll away from the shielded person to keep the smoke away from the shielded person. The eddies may break-up the smoke, block the smoke, and/or diffuse the smoke.

Referring to FIGS. 2*a* and 2*b*, the eddies 52 may be created at a variety of heights above the air outlet 46. For example, the eddies 52 may created anywhere from directly above the air outlet 46 to thirty-six inches above the air outlet 46 or higher. The eddies 52 may have a variety of diameters, ranging from one-eighth (⅛ inch) to eight (8) inches or larger. Likewise, there may be any number of eddies 52, from one eddy to hundreds of eddies 52.

Figure 3:
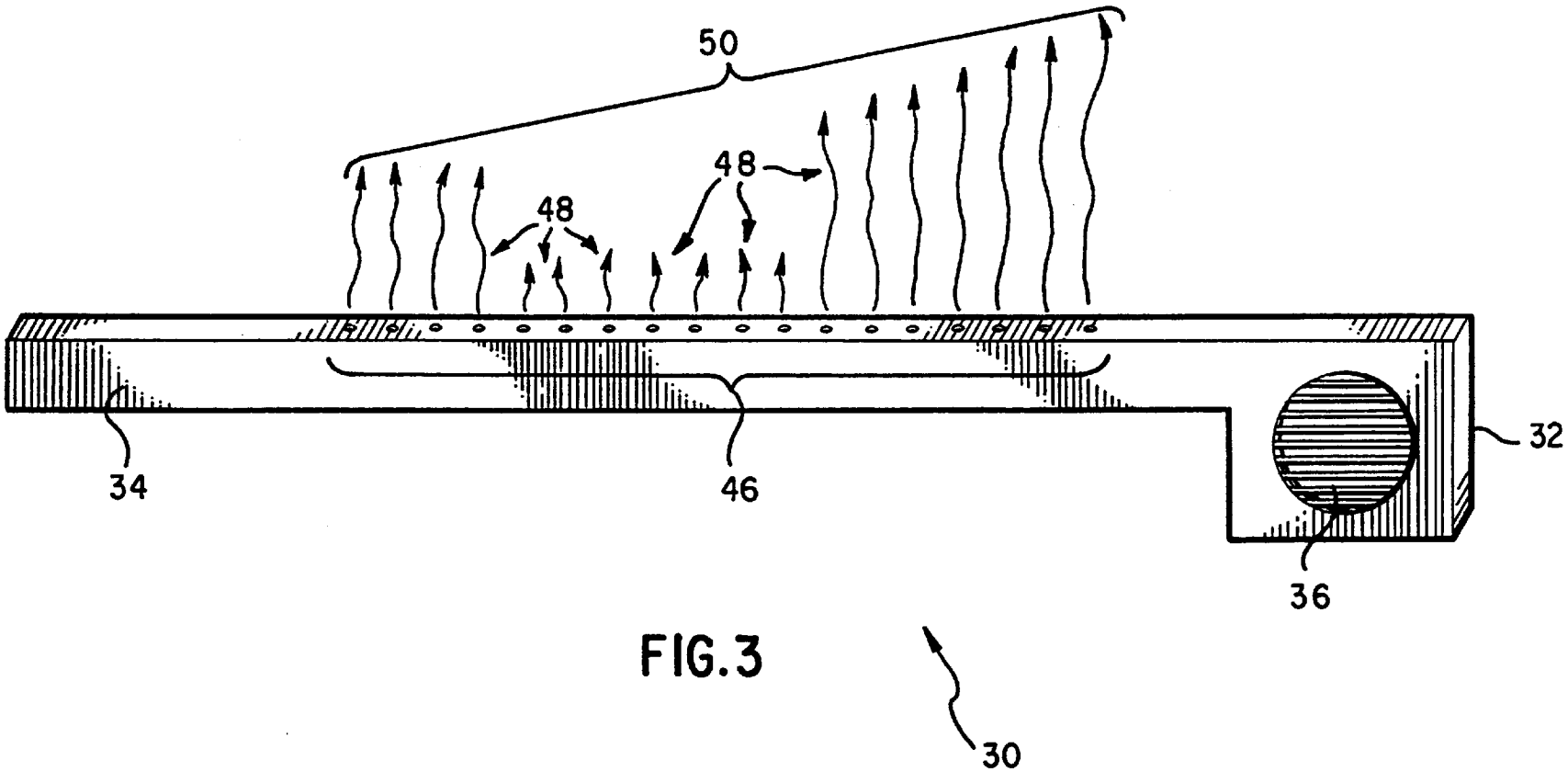
FIG. 3 shows a side view of an embodiment of the invention with a varied air barrier.

The air rail 30 may also create a barrier 50 that varies in size and strength along the length of the conduit 34. FIG. 3 shows an embodiment of the air rail 30 where the air outlet 46 is configured so that the exited air 48 is fanned out at varying heights along the length of the conduit 34. This creates a barrier 50 that is stronger or more impenetrable in certain predetermined areas. The advantage of this is that the air rail 30 may be adjusted to compensate for more smoke on one side, area, or portion of the table or coming from one direction. Likewise, the varied exited air 48 could help adjust for the ambient or existing airflow in the room. The varied exited air 48 may be achieved with adjustable holes or vents, where the size of the hole or vent may be increased or decreased, for example, by tightening a screw, a knob, or sliding a cover over the hole or vent. Likewise, the varied exited air 48 may also be achieved by increasing the number of fans 32 and varying the location of the fans 32.

Figure 4:
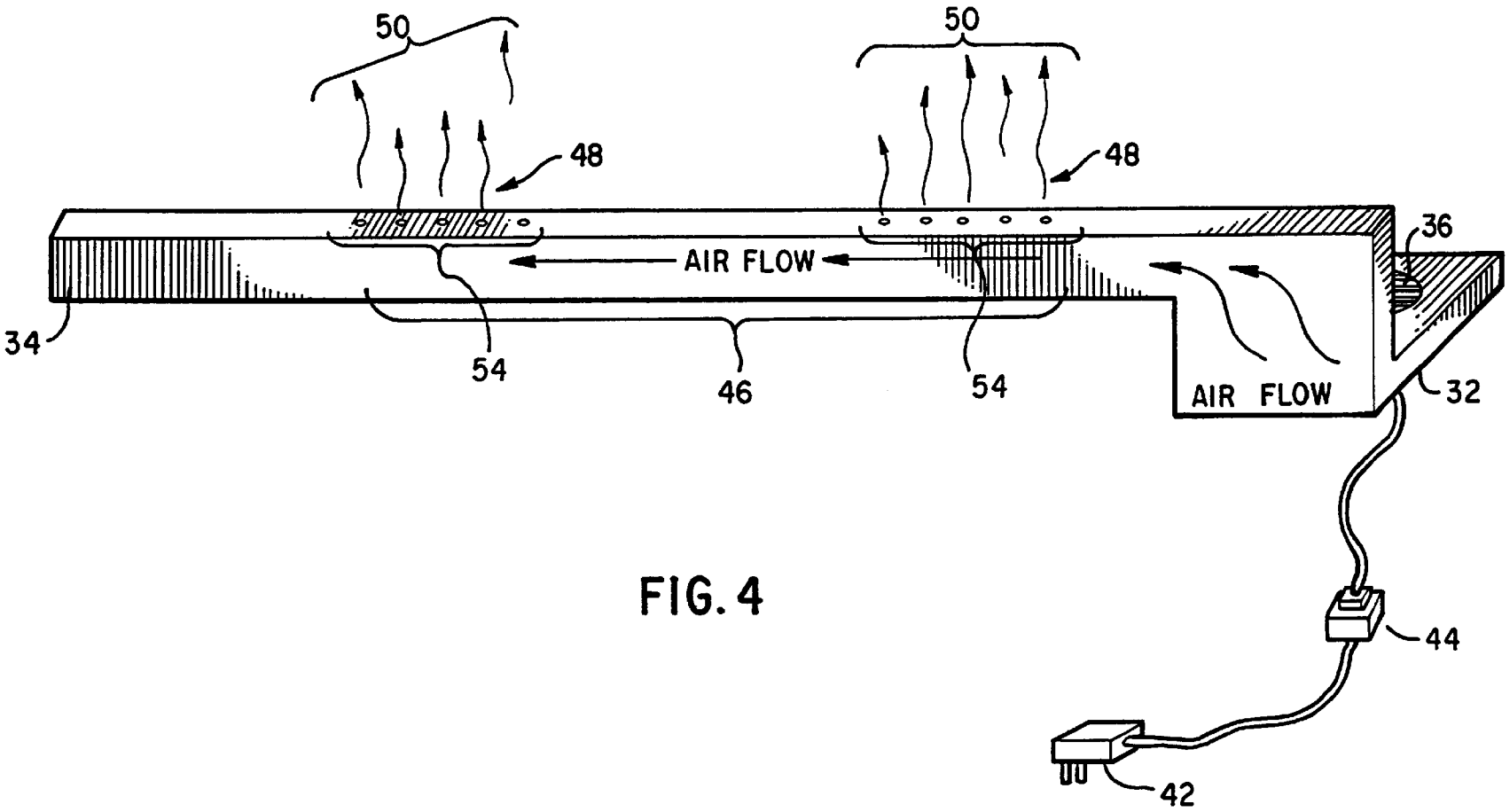
FIG. 4 shows a side view of an embodiment of the invention with a plurality of air outlet groupings.

The air rail 30 may also be designed, as seen in FIG. 4, so that the air outlet 46 is a plurality of separate groupings 54 or holes or vents. With the two groupings 54 shown in FIG. 4, the air outlet 46 creates two separate barriers 50 to smoke. Similar to the embodiment seen in FIG. 3, this is particularly effective when the smoke is flowing in particular areas, portions, or sides of the table. The groupings 54 may be located in the position found most effective to create a barrier 50 and prevent smoke from reaching the shielded person.

As noted above and shown in FIG. 4, the fan 32 may be positioned horizontally. With the fan 32 positioned as such, the intake 36 will generally also be aligned horizontally. The intake 36 may be located on the top of the fan 32, as depicted in FIG. 4, or on the bottom of the fan 32.

Figure 5A:
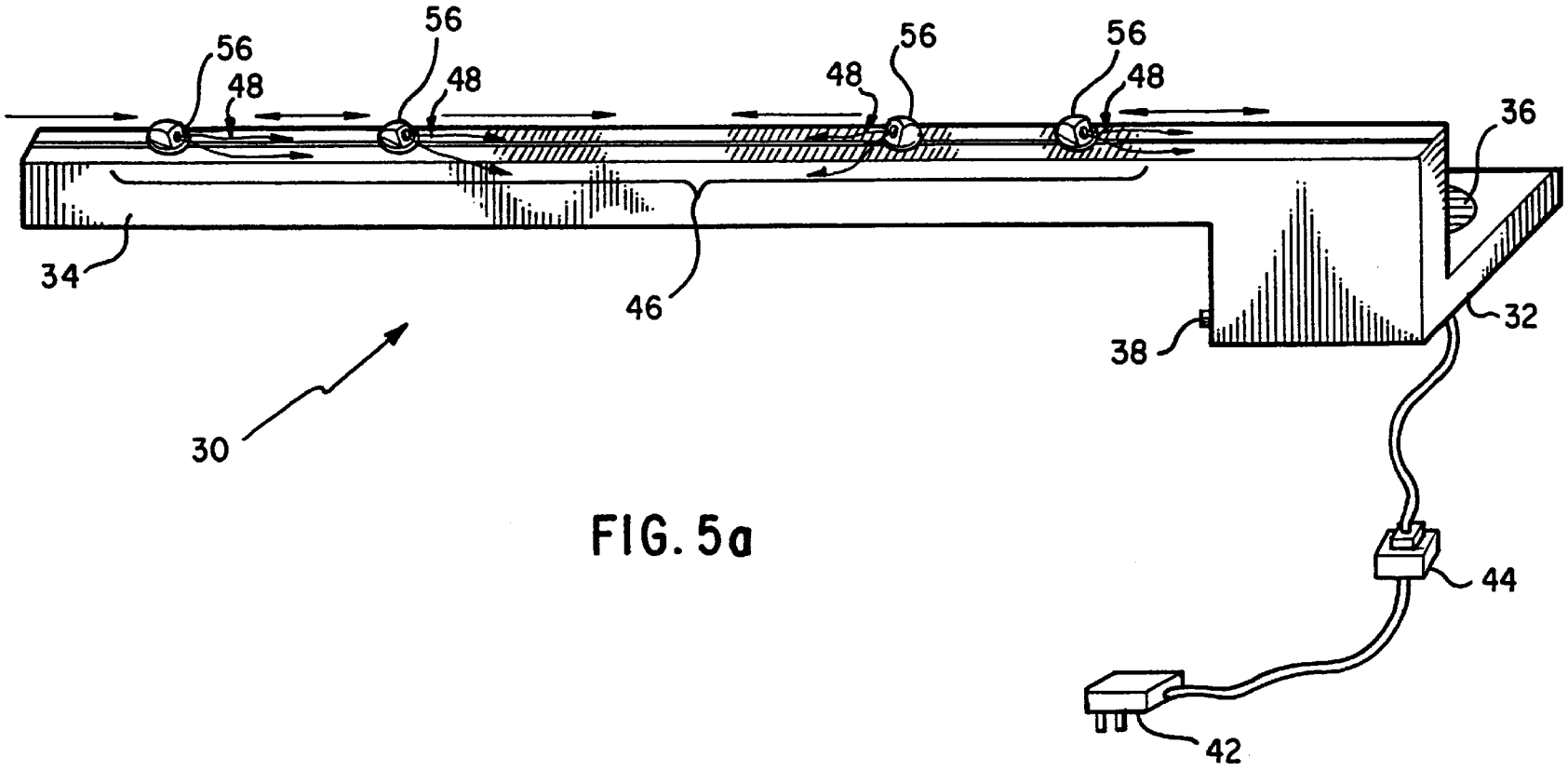
FIGS. 5*a* and 5*b* show side views of embodiments of the invention with adjustable air vents.
Figure 5B:
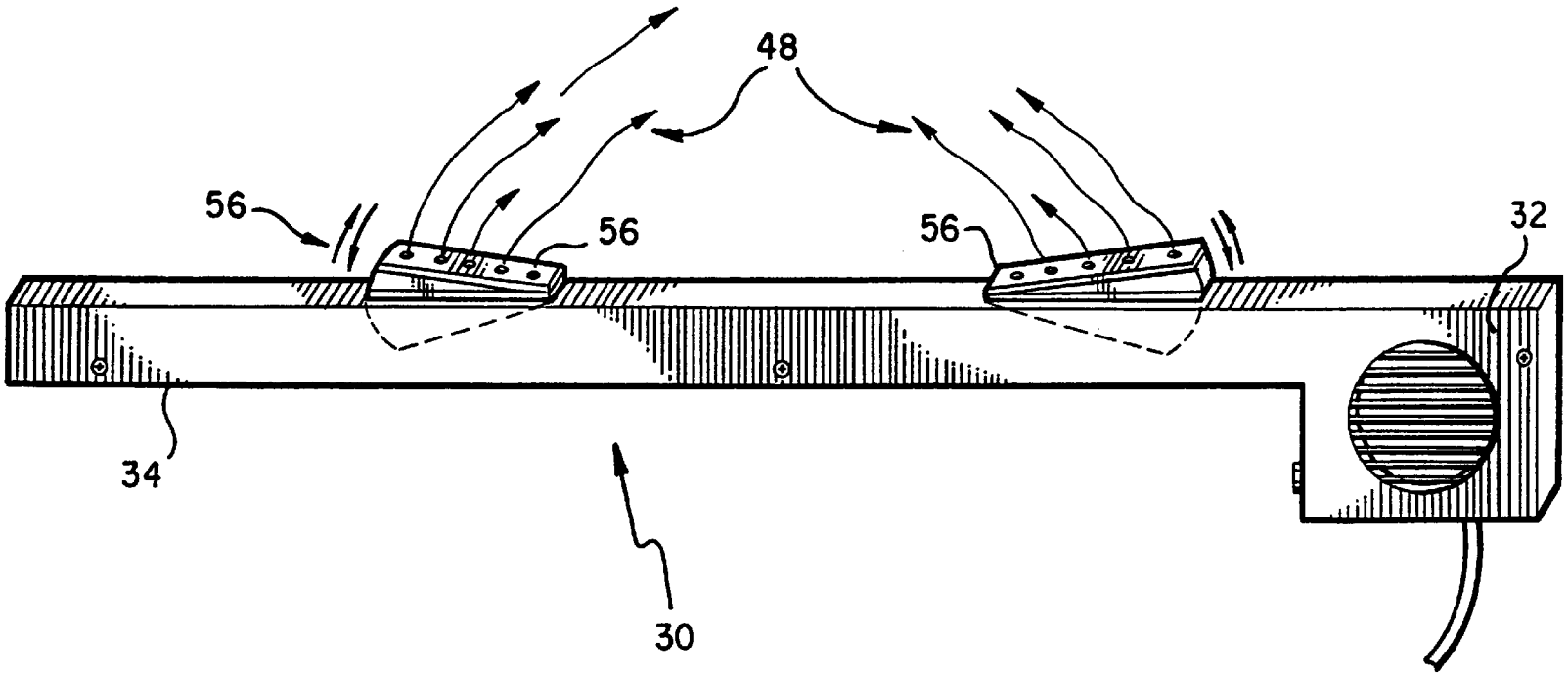
Figure 5C:
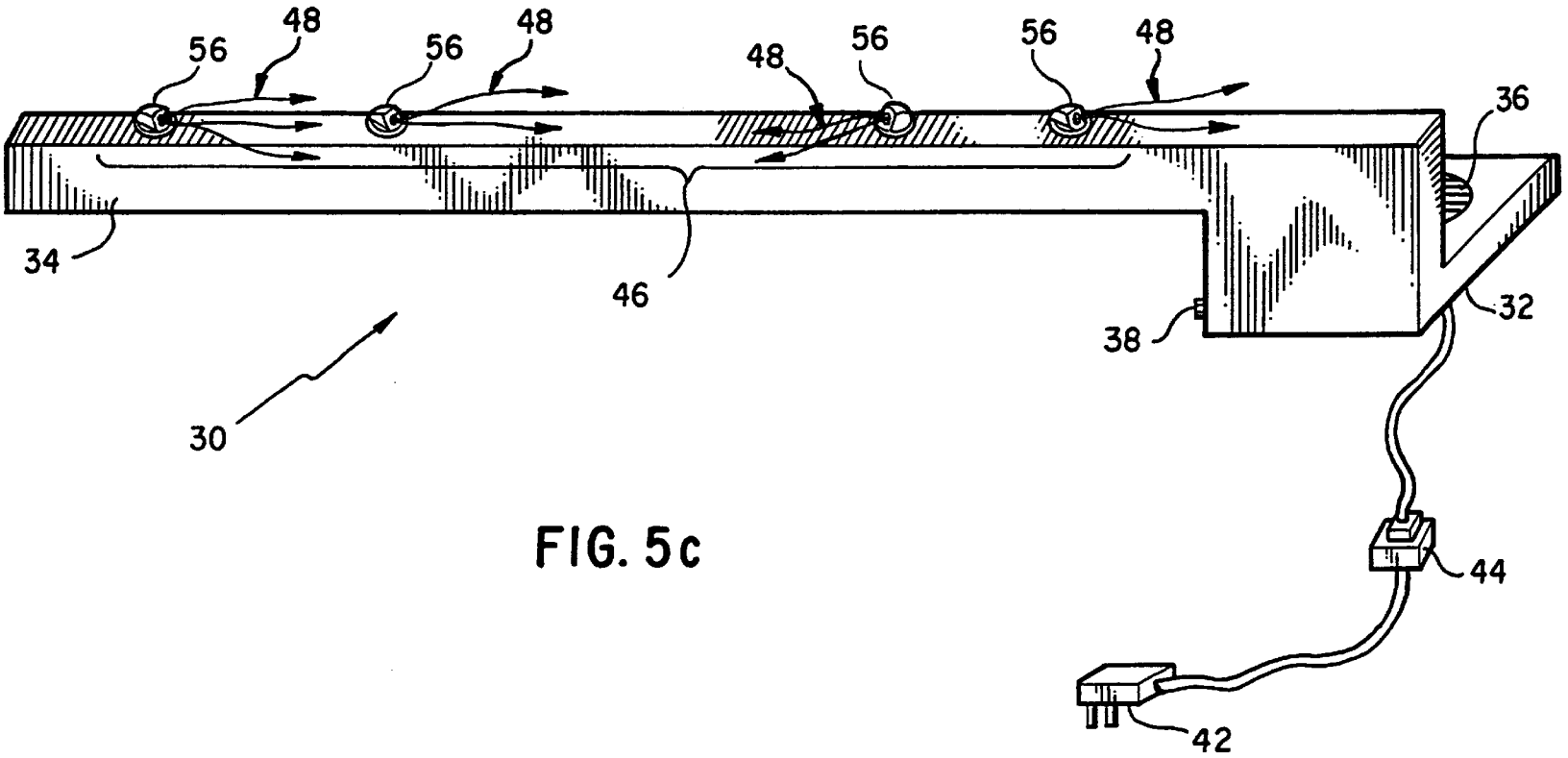

The vents or holes that comprise the air outlet 46 do not have to be stationary, but, may be moveable and adjustable. Accordingly, FIGS. 5*a* and 5*b* depict an embodiment of the air rail 30 in which the air outlet 46 is or includes adjustable vents 56. The adjustable air vents can be a variety of shapes and sizes. For example, they may the size and shape of a adjustable vent found in an automobile dashboard. Likewise, they may be the size and shape of adjustable vents in airplanes or trains. The adjustable vents 56 may be adjusted to change the direction of the exited air 48. The adjustable vents 56 may change the exited air 48 direction vertically, horizontally, rotatably, up and down, and side to side, as seen in FIG. 5*a*. The adjustable vents 56 may be, for example, on rollers, pivots, hinges, ball bearings, threads, or slides. To change the direction of the exited air 48 vertically and horizontally, for example, the adjustable vent 56 would be pivoted upwards or downwards, as shown in FIG. 5*b*. Likewise, if the adjustable vents 56 were on ball bearings, or were otherwise rotatable, the vents 56 could be turned circularly to change the direction of air flow. Such rotatable vents 56 would allow the changing of the direction of the exited air flow from forward and away from the shielded person to backwards and towards the shielded person, towards the left, or towards the right, as shown in FIG. 5*c*. Given the often unpredictable environmental conditions in a casino, this adjustability could prove useful.

As shown in FIG. 5*a*, the adjustable vents 56 are on tracks that let them slide along the length of the conduit 34. Wheels, ball bearing or other means that let them slide could be substituted. The adjustable vents 56, therefore, allow for the creation of a variety of air outlet 46 configurations. The air vents may be grouped together to create a large barrier 50 or they may be grouped separately to create a plurality of barriers 50. The adjustable vents 56 give the shielded person more control over the barrier 50 and allow the shielded person to compensate for different environmental conditions.

Figure 6A:
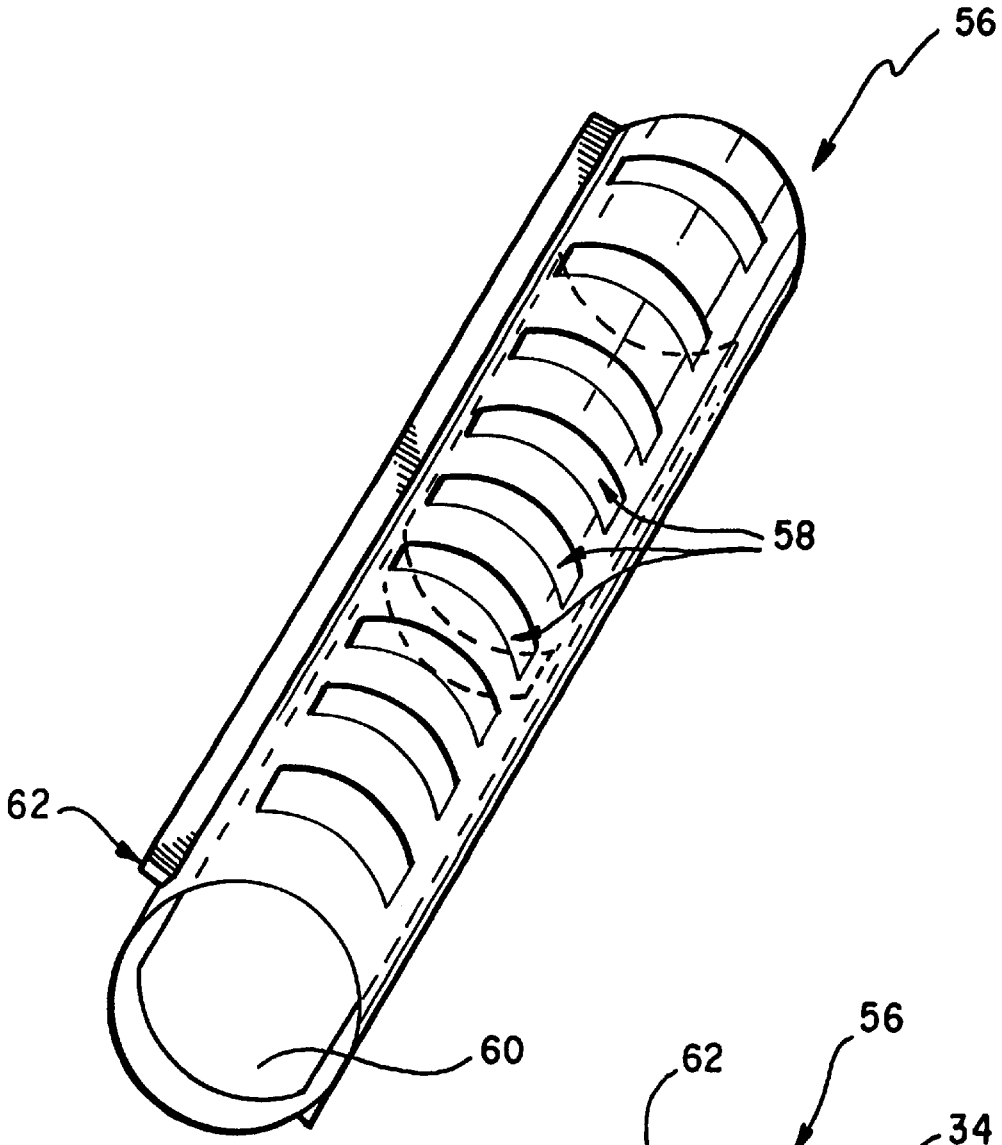
FIG. 6 shows a perspective view of an adjustable air vent of an embodiment of the invention.
Figure 6B:
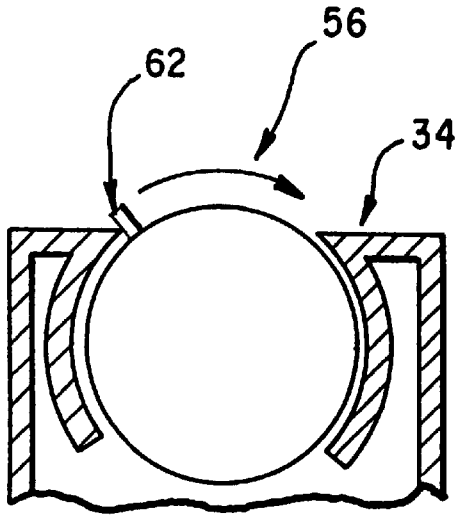

FIGS. 6*a* and 6*b* shows the air outlet portion of an air rail 30 with another variety of adjustable vent 56. In this embodiment, the adjustable vent 56 has a plurality of openings 58, a vent cover 60, and a rib 62. The openings 58 may be completely open, in which case the exited air 48 will produce a wide barrier 50. The rib 62 moves the vent cover 60. The shielded person, therefore, could move the rib 62 to move the vent cover 60 and reduce the size of the openings 58. The shielded person therefore, can use the ribs 62 to adjust the air outlet 46 to increase or decrease the exited airflow 48. Alternatively, the adjustable vent 56 may also be constructed to be rotatable within the conduit 34, thereby allowing the barrier 50 to be created at different angles. For example, when the vent cover 60 is 90% closed, the opening is aimed at a small height above the table of surface the air rail was mounted on. However, if the adjustable vent 56 were rotated counter-clockwise, the opening would be aimed at a greater height.

Figure 7:
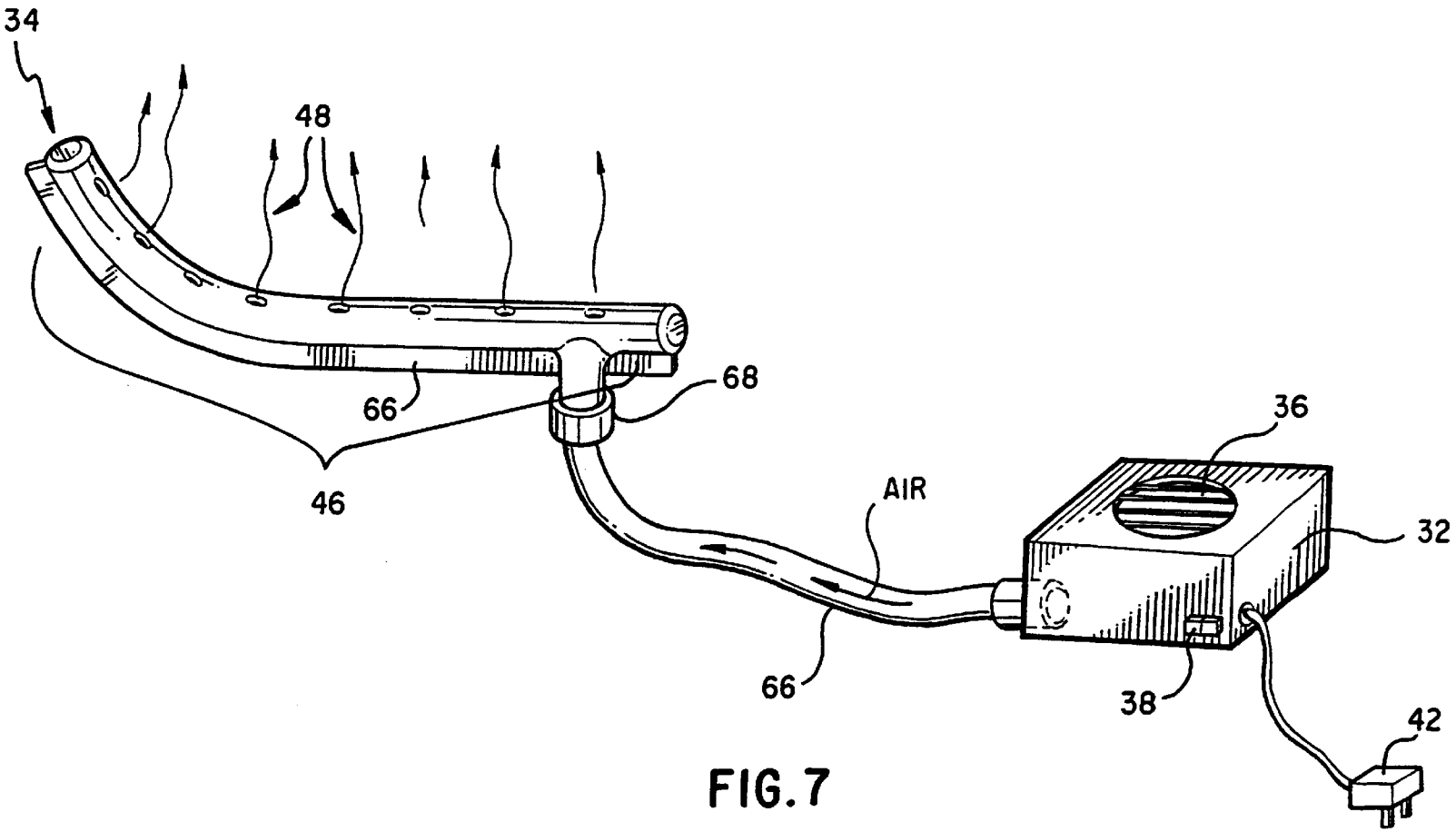
FIG. 7 shows a perspective view of an embodiment of the invention with a flexible air conduit.

The conduit 34 does not have to be a set shape or length. Rather, as FIG. 7 shows, the air rail 30 may have a flexible conduit 34. This flexible conduit 34 is comprised of flex line 66 and may be made of a variety of flexible or malleable materials, including rubber, plastic, composite, man-made or natural material. The flexible conduit 34 typically has approximately the same size range as described above for the conduit 34. The flex line 66 is positioned along an existing rail or trim on one side of a table. Preferably, the flex line 66 may be secured to the existing rail with a lip (not shown) or other connecting means. For example, an existing table railing, molding, or padding (not shown) could be removed, the flex line 66 placed on the edge of the table, and the railing remounted so that it applies a pressure on the lip and holds the flex line 66 in place. As shown in FIG. 7, the flexible conduit 34 may be comprised of a plurality of flex lines 66. A plurality of flex lines 66 allow for greater ease in use and installation, as well as a greater variety of configurations. The flex lines 66 are connected to each other and to the fan 32 with a connector 68, which securely holds them together.

Figure 8A:
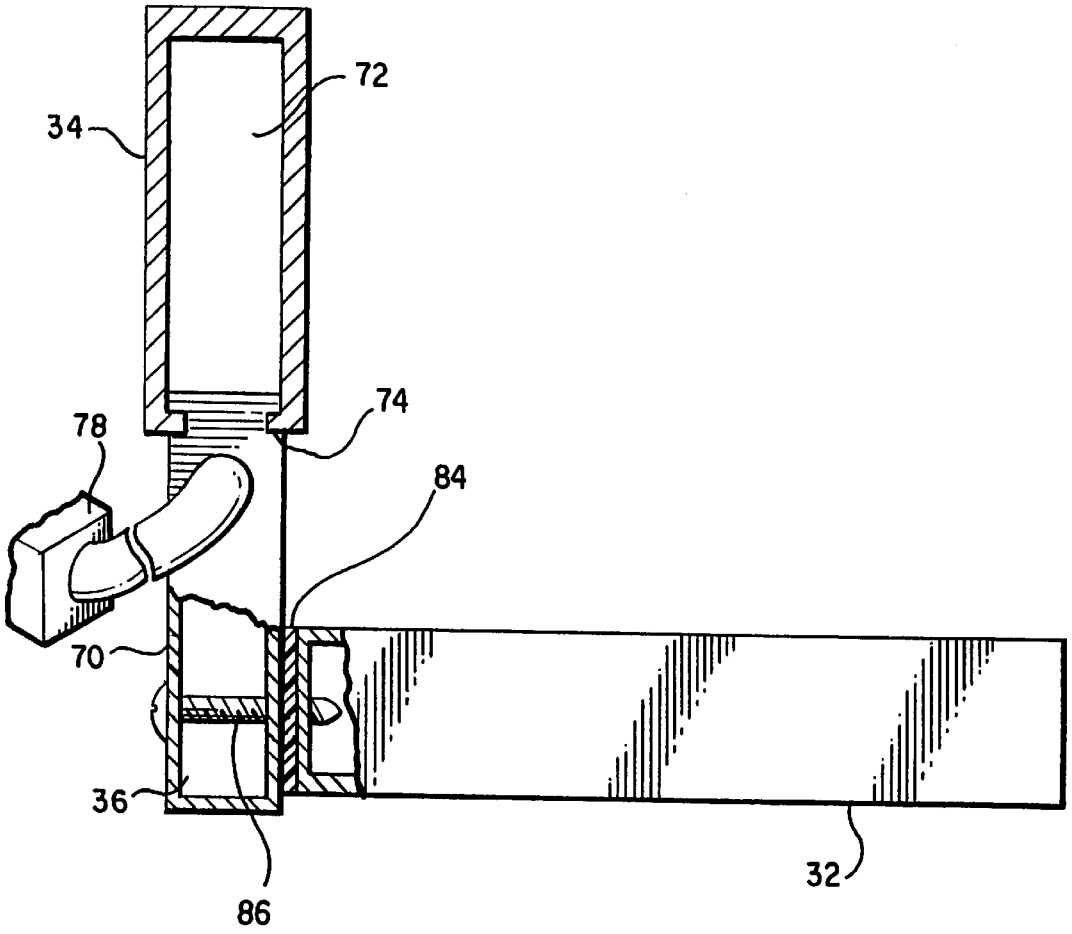
FIGS. 8*a*, 8*b*, and 8*c* show end, front and back views of the fan, transition piece and a portion of the conduit of an embodiment of the invention.
Figure 8B:
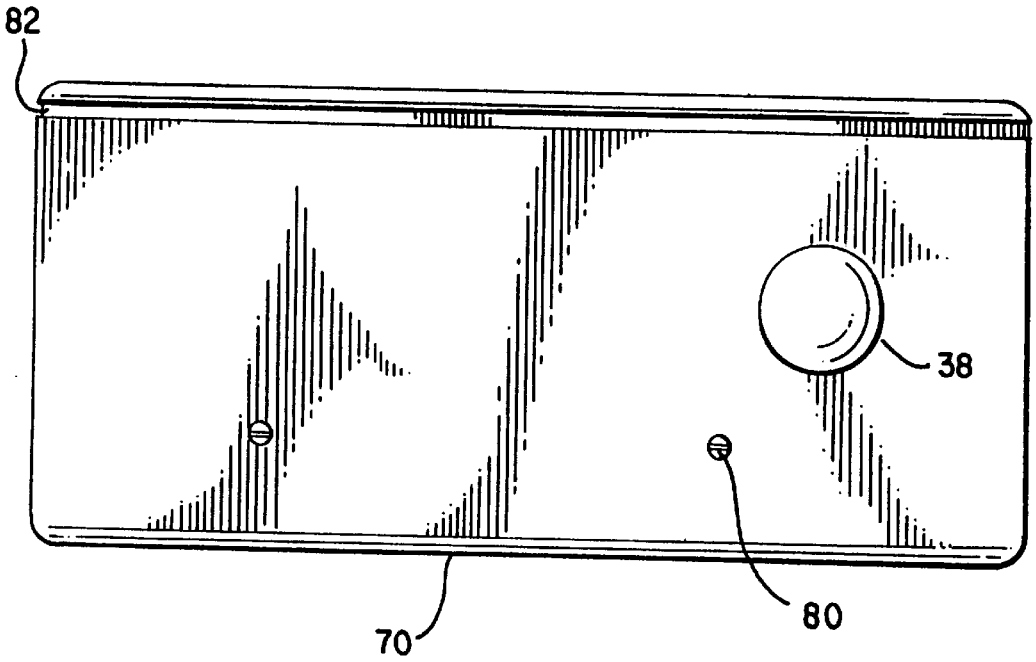
Figure 8C:
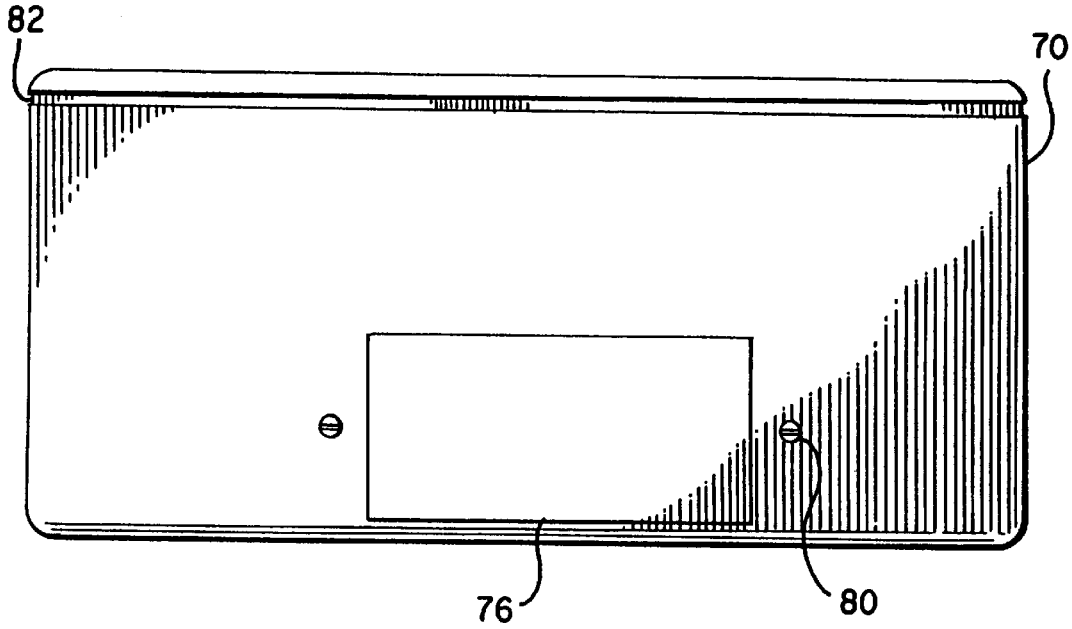

FIGS. 8*a*, 8*b*, and 8*c* show a section of the air rail 30 in greater detail than the FIGS. 1 through 7. As seen in FIG. 8*a*, the present embodiment of the air rail 30 comprises a fan 32, an conduit 34, and a transition piece 70. The fan 32 is similar to the fan 32 described above, with reference to FIGS. 1 and 4, and is positioned horizontally with the intake 36 (not shown) located on the bottom of the fan 32.

The conduit 34 is also constructed similarly to the conduit 34 described above, with reference to FIGS. 1 to 7. Referring again to FIG. 8*a*, the conduit 34 also has an air chamber 72 and track guide 74. The air chamber 72 is filled with the moved air or air flow created by the fan 32. The track guide 74 is located in the air chamber, a the bottom of the conduit 34 and is comprised of two opposing tracks. The track guide 74 allows the transition piece 70 to connect with the conduit 34, as is described below.

The transition piece 70 connects the fan 32 to the conduit 34 and allows the fan 32 to be placed at different positions along the conduit's 34 length. Although the transition piece can be a variety of sizes, the transition piece 70 is preferably approximately four to eight inches long, two to four inches tall, and one-half to one inch thick. Generally, the transition piece 70 will be approximately the same width as the conduit. The transition piece 70, as shown in FIGS. 8*a*, 8*b*, and 8*c*, includes an air chamber intake 76, an air chamber output (not shown), a DC adapter plug 78, mounting screw holes 80, an on/off switch 38, and glide tracks 82. The air chamber intake 76 is an opening that allows the moved air or air flow created by the fan 32 to enter the transition piece 70, through the fan outlet, and pass through the air chamber output and into the conduit's 34 air chamber 72. The fan 32 is mounted so that the fan outlet aligns with the air chamber intake 76 with a gasket 84 and mounting screws 86 (seen in FIG. 8*a*) that pass through the mounting screw holes 80. The gasket 84 is secured to the fan 32 and has holes (not shown) for the screws 86 to pass through. When the screws 86 are tightened through the gasket 84, the fan 32 is secured to the transition piece 70. The on/off switch 38 turns the power, DC or AC, on and off. The DC adaptor plug 78 simply allows power from a DC adaptor to pass through a cord (not shown) and to the fan 32.

The glide tracks 82 are indentations that run the length of the transition piece 70. The transition piece 70 connects to the conduit 34 by sliding the glide tracks 82 over the track guides 74 of the conduit 34. Connected as such, the transition piece 70 is slid along the track guides 74 to any position along the length of the conduit 34. Therefore, the fan 32 can be placed at any position along the length of the conduit 34. Likewise, additional transition pieces 70 and fans 32 can be added to the air rail. The variable positioning of the fan 32 or fans 32 provides greater flexibility in the installation and use of the air rail 30.

One example of an air rail 30 construction and installation is as follows. Generally, the conduit 34 is built to a length appropriate for the table the air rail 30 is being installed on. Typically, for a standard 4 foot casino gaming table, the length of the conduit 34 would be approximately four feet. The fan 32 is then mounted on the transition piece 70, using a screw 86 and gasket 84 as described above with reference to FIG. 8*a*. Next, the transition piece 70 is connected to the conduit 34 with the glide track 82 as described above with reference to FIG. 8*a*. The transition piece 70 and fan 32 are slid along the conduit 34 until the best position is found. A filler (not shown) is placed in the bottom of the conduit 34 to provide an air-tight seal of the opening on the bottom of the conduit 34 not covered by the transition piece 70. The filler is typically made of the same material as the conduit 34 or transition piece 70, and is designed to fit in the bottom of the conduit 34, resting on the track guides 74. Both ends of the conduit 34 are sealed, and the air rail 30 is ready to be installed.

The air rail 30 is installed by connecting the conduit 34 to the table. For example, in one embodiment the conduit 34 has screw or bolt holes and is screwed or bolted to the table through the screw or bolt holes. Alternatively, an adhesive could be used to connect the conduit 34 to the table.

Figure 9A:
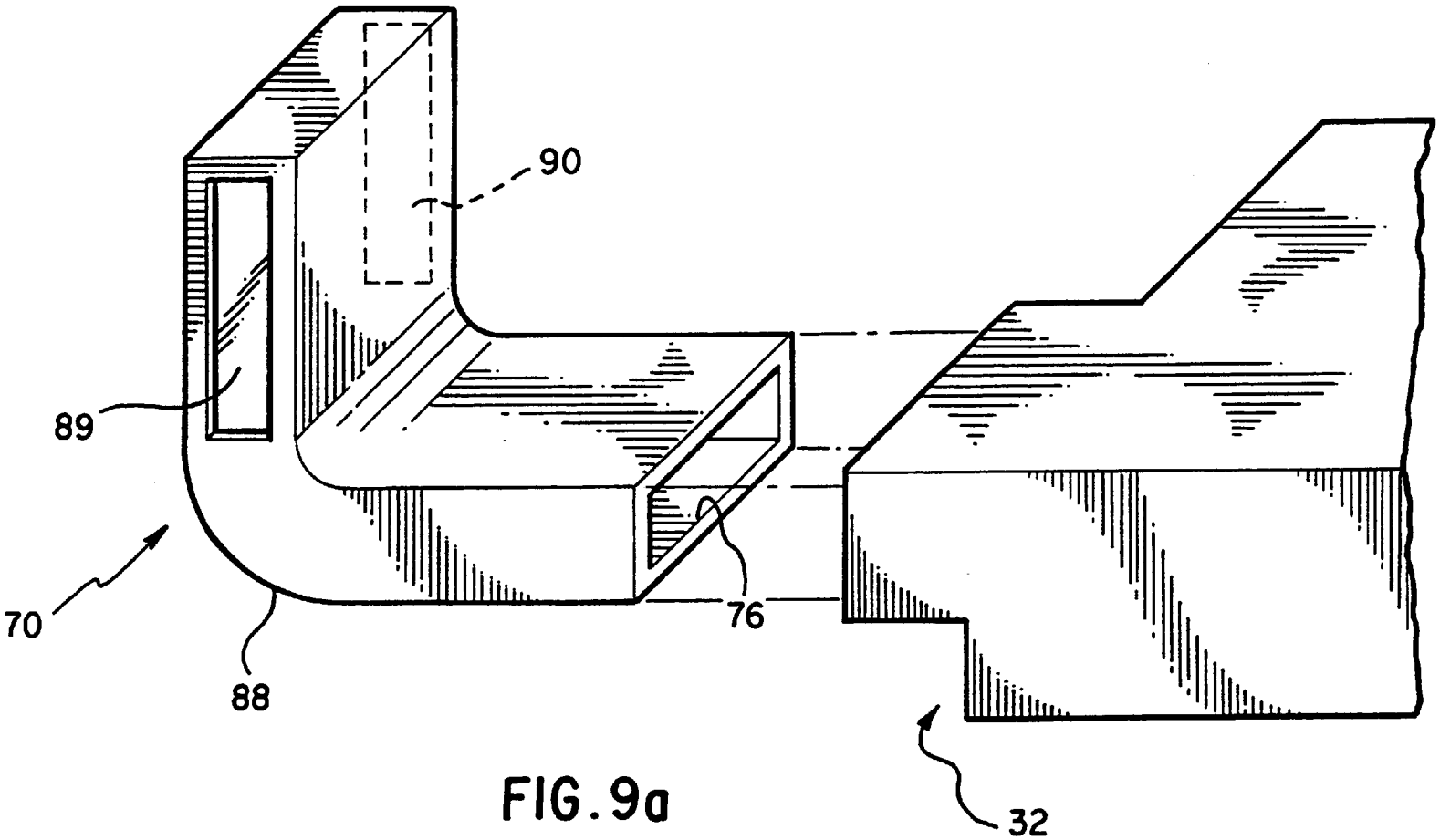
FIGS. 9*a*, 9*b*, and 9*c* show perspective views of the fan, transition piece and a portion of the conduit of an embodiment of the invention.
Figure 9B:
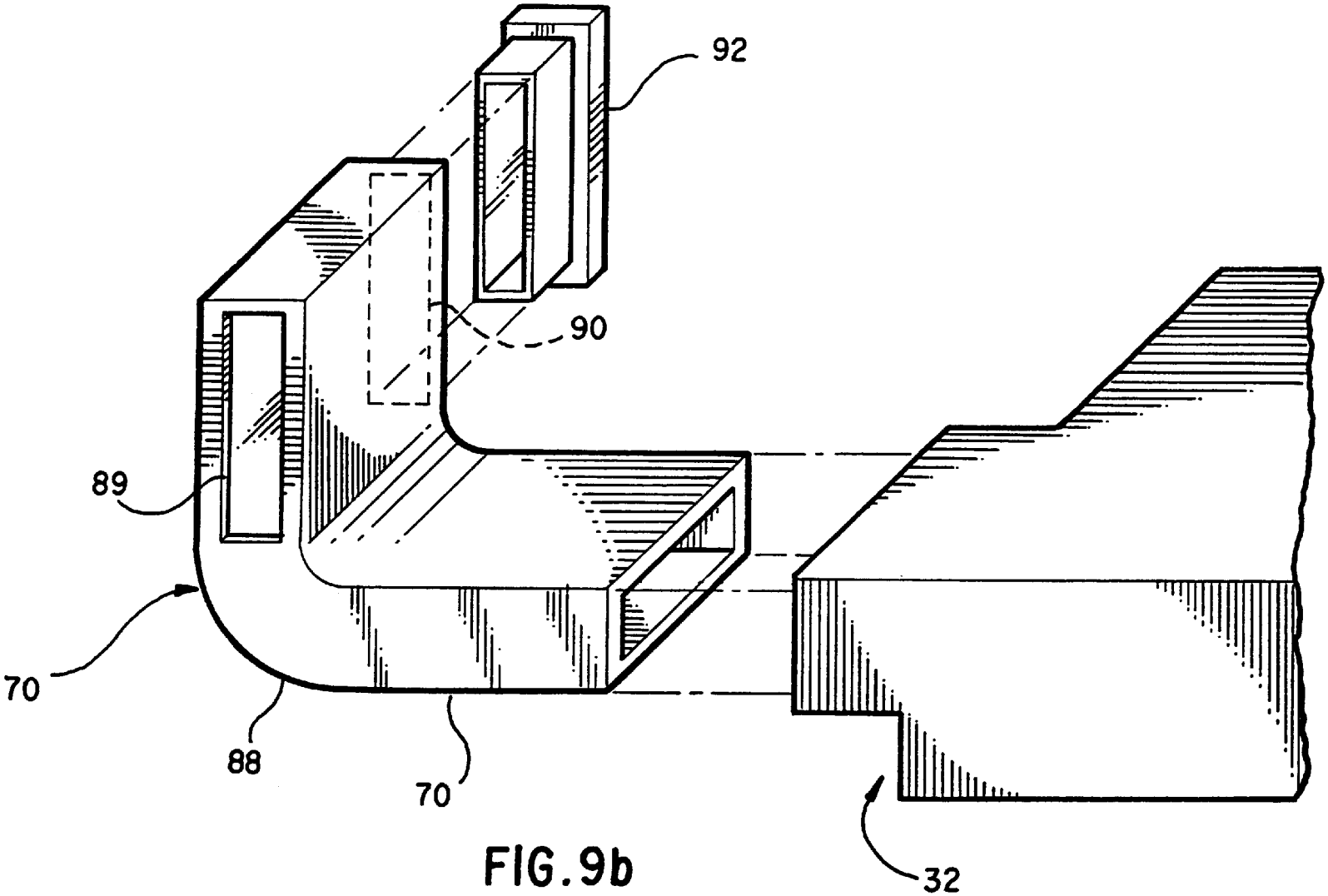
Figure 9C:
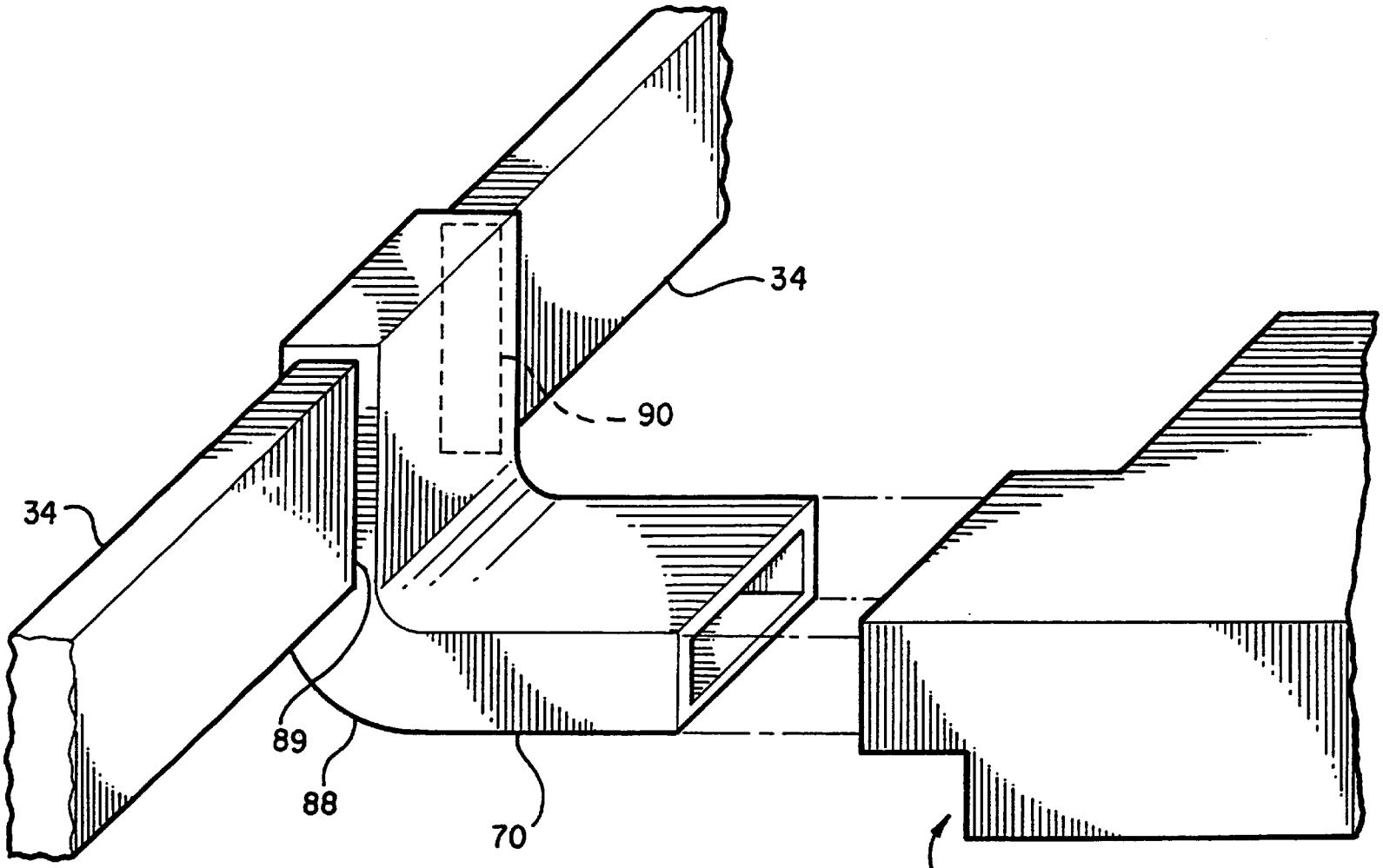

FIGS. 9*a*, 9*b*, and 9*c* show an alternative embodiment of the air rail 30 that also allows the fan 32 to be placed, mounted, and/or installed anywhere along the length of the conduit 34. In FIG. 9*a*, the transition piece 70 is an elbow 88 with an air chamber intake 76 a left outlet 8 and a right outlet 90. The air chamber intake 76 is connected to the fan 32 by sliding the intake 76 into an opening (not shown) in the fan 32. The air chamber intake 76 allows the moved air or air flow created by the fan 32 to enter the air chamber 72 of the conduit 34. When the fan is located at one end of the conduit 34, the end of the conduit 34 is placed in either the left outlet 89 or right outlet 90 of the elbow 88 and a cap 92 is placed on the other outlet, as shown in FIG. 9*b*. If the fan 32 is located somewhere, such as the middle of the conduit 34, other than the end of the conduit 34, the conduit 34 is cut into two pieces at the point where the fan 32 is to be located. The opposing ends of the conduit 34 pieces are placed in the left outlet 89 and right outlet 90 of the elbow 88, as shown in FIG. 9*c*. The conduit 34 fits tightly into the outlets and is thus held in by pressure. However, the conduit 34 may be held in place by glue or screws. The glue would be placed on the ends of the conduit 34 being placed into the outlets, while the screws would be screwed through transition piece 70 and into the conduit 34.

The air rail 30 has been described above as being used with a table, and is generally envisioned being used on a gaming table and blocking smoke. In most casinos, the gaming tables will be used in a room with a floor and a ceiling. However, gaming tables may be used in open air casinos without ceilings. Furthermore, it is noted, however, that the air rail 30 may be used in any locale where air borne nuisances are a problem for the shielded person. For example, the air rail 30 may be used on a bar so that it shields bartenders from the smoke of bar patrons. The air rail 30 may be whatever length is necessary to be used on a bar or any other place. Ideally, to create a sufficient barrier, there should be more than one fan. A fan 32 for every six feet of the conduit 34 operates well. However, with better conditions or fan power, the distance between fans may be increased.

The terms and descriptions used here are set forth by way of illustration only and are not meant as limitations. Those skilled in the art will recognize that numerous variations are possible within the spirit and scope of the invention as defined in the following claims.

What is claimed is:

1. An air rail apparatus for minimizing an amount of second-hand smoke reaching a location adjacent to a table, comprising:

a fan, wherein air is moved or an air flow is created;

a conduit, operably connected to the fan, removably attachable to a table and interposed between a location adjacent to the table and an airborne nuisance at the table, wherein a substantial portion of the moved air or the created air flow enters the conduit and travels through the conduit, and wherein the conduit comprises:

a top; and an air outlet, located on the top of the conduit, wherein a substantial portion of the air that travels through the conduit exits through the air outlet, whereby the exited air may be interposed between the location adjacent to the table and the airborne nuisance.

2. The apparatus of claim 1 wherein the air outlet is configured so that the exited air creates an air barrier or buffer between the location adjacent to the table and the airborne nuisance.

3. The apparatus of claim 1 wherein the table has a table top and the exited air flows away from the table top.

4. The apparatus of claim 3 wherein the table top forms a plane and wherein the air exits at a ninety-degree angle to the plane of the table towards a ceiling.

5. The apparatus of claim 3 wherein the table top forms a plane and wherein the air exits at an acute angle to the plane of the table towards a ceiling and away from the location adjacent to the table.

6. The apparatus of claim 1 wherein the exited air flow creates at least one eddy or rolling airflow above the table, wherein the eddy acts as a buffer or barrier minimizing the second hand smoke that reaches the shielded person.

7. The apparatus of claim 6 wherein at least some of the second hand smoke is caught up in the eddy but does not pass through the main flow of the exited air.

8. The apparatus of claim 6 wherein the eddy is at least six inches above the table.

9. The apparatus of claim 6 wherein multiple eddies are created by the exited air flow at different heights above the table.

10. The apparatus of claim 1 wherein the conduit is greater than 18 inches in length.

11. The apparatus of claim 1 wherein the conduit is plastic.

12. The apparatus of claim 1 wherein the conduit is flexible.

13. The apparatus of claim 12 wherein the conduit comprises at least one flexible line or flexible tube.

14. The apparatus of claim 1 wherein the conduit comprises connectors.

15. The apparatus of claim 1 wherein the table has a table top and wherein the conduit is removably attachable to the table top.

16. The apparatus of claim 1 wherein the table has a table top and a table side and the conduit has a top and is removably attachable on the table side and wherein the air outlets are on the top of the conduit and above the plane of the table top.

17. The apparatus of claim 1 wherein the table has an edge between the table top and a table side and wherein the conduit is removably attachable to a trim or rail running around the edge of the table.

18. The apparatus of claim 1 wherein the conduit has a length and a lip running along a portion of the length of the conduit, whereby the lip is used to secure the conduit to the table.

19. The apparatus of claim 1 wherein the air outlet comprises one or more holes in the conduit.

20. The apparatus of claim 19 wherein the holes are separated by least one inch spacing.

21. The apparatus of claim 19 wherein the holes are circular.

22. The apparatus of claim 19 wherein the holes are rectangular.

23. The apparatus of claim 1 wherein the air outlet comprises one or more vents.

24. The apparatus of claim 1 wherein the air outlet is an adjustable vent.

25. The apparatus of claim 1 wherein the air outlet is adjustable to increase or decrease the exited air flow.

26. The apparatus of claim 1 wherein the air outlet is adjustable to change the direction of the exited air flow from the air outlet.

27. The apparatus of claim 26 wherein the exited air flow direction can be adjusted forwards and backwards.

28. The apparatus of claim 26 wherein the exited air flow direction can be adjusted from side to side.

29. The apparatus of claim 26 wherein the air outlet is a fully rotatable nozzle.

30. The apparatus of claim 29 wherein the exited air flows from the fully rotatable nozzle at an acute angle to a plane formed by the table.

31. The apparatus of claim 30 wherein the acute angle is sixty degrees.

32. The apparatus of claim 26 wherein the air exits the air outlet at an angle and the angle can be adjusted.

33. The apparatus of claim 1 wherein the exited air is fanned out at differing vertical heights.

34. The apparatus of claim 1 wherein the exited air flow is in different vertical planes.

35. The apparatus of claim 1 wherein the speed of the exited air flow from the air outlet is adjustable.

36. The apparatus of claim 35 further comprising a speed selector operably connected to the fan that can adjust the speed of the fan.

37. The apparatus of claim 1 further comprising a filter for filtering the air, the filter operably connected to the fan.

38. The apparatus of claim 1 wherein the fan is a first fan, the apparatus further comprising a second fan, wherein the second fan is connected to the conduit at a different location than the first fan.

39. The apparatus of claim 1 wherein the conduit has a length and the fan is positioned at a point along the length of the conduit.

40. The apparatus of claim 39 wherein the point the fan is positioned at is changeable.

41. The apparatus of claim 1 further comprising:

a transition piece, wherein the fan is mounted onto the transition piece and whereby the transition piece connects the fan to the conduit and allows a substantial portion of the moved air or created air flow to enter the conduit.

42. The apparatus of claim 1 further comprising a connector, wherein the connector connects the apparatus to the table.

43. A method for eliminating, reducing, or minimizing the amount of smoke that reaches a predetermined location, comprising:

providing an air rail removably attachable to a table; and creating an air flow, from the air rail, in a generally vertical direction along substantially all of a side of the table closest to the predetermined location, wherein the created air flow is interposed between the predetermined location and an airborne nuisance so that the airborne nuisance comes into contact with the created air flow and is dispersed, redirected away from the predetermined location, or diffused into smaller amounts.

44. The method of claim 43, wherein the creating step comprises the steps of:

removably attaching an air rail to the side of the table closest to the person, wherein the air rail comprises a fan, a conduit with a top, and an air outlet on the top of the conduit; and generating the air flow with the fan, wherein the air flow enters the conduit and exits from through the air outlet.

45. An air rail apparatus for minimizing the amount of second-hand smoke reaching a location adjacent to a table, comprising:

a fan, wherein air is moved or an air flow is created;

a conduit, operably connected to the fan and attachable to a table and interposed between the location adjacent to the table and an airborne nuisance at the table, wherein a substantial portion of the moved air or the created air flow enters the conduit and travels through the conduit, and wherein the conduit comprises:

a top forming a plane and wherein the air exits at an acute angle to the plane of the table; and an air outlet, located on the top of the conduit, wherein a substantial portion of the air that travels through the conduit exits through the air outlet, whereby the exited air may be interposed between the location adjacent to the table and the airborne nuisance.

46. An air rail apparatus for minimizing an amount of second-hand smoke reaching a location adjacent to a table, comprising:

a fan, wherein air is moved or an air flow is created;

a conduit, operably connected to the fan and attachable to a table and interposed between the location adjacent to the table and an airborne nuisance at the table, wherein a substantial portion of the moved air or the created air flow enters the conduit and travels through the conduit, and wherein the conduit comprises:

atop; and an air outlet, located on the top of the conduit, wherein a substantial portion of the air that travels through the conduit exits through the air outlet, whereby the exited air maybe interposed between the location adjacent to the table and the airborne nuisance and wherein the fan may be slideably positioned at different positions along the conduit.

47. The air rail apparatus of claim 46, further comprising adjustable vents movably positioned along the length of the conduit.

48. An air rail apparatus for minimizing an amount of second-hand smoke reaching a location adjacent to a table, comprising:

a fan, wherein air is moved or an air flow is created;

a conduit, operably connected to the fan and attachable to a table and interposed between the location adjacent to the table and an airborne nuisance at the table, wherein a substantial portion of the moved air or the created air flow enters the conduit and travels through the conduit, and wherein the conduit comprises:

atop; and an air outlet, located on the top of the conduit, wherein a substantial portion of the air that travels through the conduit exits through the air outlet, whereby the exited air may be interposed between the location adjacent to the table and the airborne nuisance and wherein the length of the conduit is adjustable.

* * * * *

UNITED STATES PATENT AND TRADEMARK OFFICE

CERTIFICATE OF CORRECTION

PATENT NO. : 6,210,267 B1
DATED : April 3, 2001
INVENTOR(S) : Shane Long and David Warren It is certified that error appears in the above-identified patent and that said Letters Patent is hereby corrected as shown below:

Claim 20,
Line 2, after "separated by", please insert -- at --.

Claim 46,
Line 11, please change "atop" to -- a top --; and
Line 15, please change "maybe" to -- may be --.

Claim 48,
Line 11, please change "atop" to -- a top --.

Signed and Sealed this

Sixth Day of November, 2001

*Attest:*

Nicholas P. Godici

*Attesting Officer*

NICHOLAS P. GODICI
*Acting Director of the United States Patent and Trademark Office*